United States Patent [19]

Santucci et al.

[11] 4,068,685

[45] Jan. 17, 1978

[54] SUPPORTING MEMBERS FOR A REVOLVING COMB ON A MULTISHED WEAVING LOOM

[75] Inventors: Nicola Santucci, Schio (Vicenza), Italy; Zabotin Aleksandr Aleksandrovic, Moscow, U.S.S.R.; Loschilin Evghenii Dmitrievich, Moscow, U.S.S.R.; Galperin Aleksandr Lvovich, Moscow, U.S.S.R.; Onikov Eduard Archakovich, Moscow, U.S.S.R.

[73] Assignees: Nuovo Pignone S.p.A., Italy; ZNIKHBI: Tsentralny Nauche - issledevatelsky institut khlopehatobumezhnol promyshlennestl, U.S.S.R.

[21] Appl. No.: 728,238

[22] Filed: Sept. 30, 1976

[30] Foreign Application Priority Data

Oct. 3, 1975 Italy ..... 27953/75

[51] Int. Cl.[2] ..... D03D 49/60; D03D 47/26

[52] U.S. Cl. ..... 139/188 R; 139/436

[58] Field of Search ..... 139/188–191, 139/436; 198/597

[56] References Cited

U.S. PATENT DOCUMENTS

| | | | |
|---|---|---|---|
| 3,705,605 | 12/1972 | Titov | 139/436 |
| 3,863,680 | 2/1975 | Titov et al. | 139/436 |
| 3,895,654 | 7/1975 | Welzel et al. | 139/436 |
| 3,990,484 | 11/1976 | Steiner | 139/436 |

*Primary Examiner*—James Kee Chi

*Attorney, Agent, or Firm*—Morgan, Finnegan, Pine, Foley & Lee

[57] ABSTRACT

In a multished weaving loom, the revolving comb is reliably supported by members in the form of a certain number of roliers or pads or combination roller-pads having a bladelike configuration, to be inserted in the interdisk gaps of the revolving comb so as to rest on the interdisk spreaders.

5 Claims, 4 Drawing Figures

SUPPORTING MEMBERS FOR A REVOLVING COMB ON A MULTISHED WEAVING LOOM

This invention relates to a system for supporting, at intermediate points, a revolving comb in a multished loom.

In such machines, the insertion of the weft between the warp threads takes place simultaneously at a plurality of points in the fabric-formation line by the use of specially provided weft-carriers which are displaced perpendicularly to the warp threads, and, in phase with the formation of the shed, the grasping and the beating-up of the thread.

Grasping and beating-up of the thread according to any of the conventional methods takes place by means of a set of disks having an appropriate profile and mounted gangwise on a shaft and arranged helically, the helix pitch being determined as a function of the mutual distance between the weft-carriers.

These disks are mutually spaced apart from one another so as to leave, between consecutive disks, the space which is required to allow the pass of one or more warp threads which are held taut in parallel to the planes of the disks, so that a portion of the disks may protrude between the warp threads, whereas the remaining portion and the shaft on which they are mounted remain on the opposite side. For technical reasons, the shaft diameter cannot be chosen at random and thus for fabrics of large heights the revolving comb is, intrinsically, a particularly flexible component part.

It is known that a shaft, resting on its ends, is elastically deformed according to the laws of statics and that, in order to keep these deformations within an acceptable range, intermediate supporting members are used. If the shaft is in rotation, the supporting members generally are formed by cylinders which rotate about axes parallel to the axis of the shaft and rest against the latter. These supporting members, in addition to preventing static deformations, also have the task of preventing the dynamic instability of the rotary shaft.

From the description given above of the revolving comb, it is apparent that, in this case, the usual supporting members for rotary shafts cannot be applied or, if applied, give rise to functional problems. As a matter of fact, the disks mounted on the revolving comb are of a small thickness, have a non circular outline which is crenellated according to the weaving requirements. In addition the warp threads should sweep the bottom of the gap which exists between consecutive teeth on a side of the shaft.

To solve this problem, a known device comprises an array of one or more cylinders of a synthetic material in contact with the projections of the disks referred to above. With this approach, a narrow contact surface is provided between the shaft and the supporting member. This renders the supporting action questionable, discontinuous and short-lived.

Another approach comprises rollers resting against portions of the contour outline of the disks of the revolving comb which this approach the rollers are rotated with the comb and at the same revolving speed. In this arrangement the resting area between the shaft and the supporting member remains narrow. Moreover due to the size the supporting rollers must be by necessity, they cannot be placed against the shaft by freely selecting the positon which is deemed the most efficient in order to counteract the forces which are active upon the shaft and which are caused by the weft shot.

Another known device consists of a fixed surface on which the projections of the contour outline of the revolving comb disks slide. It is apparent, however, that this device has serious functional and structural defects.

An object of the present invention is to support the revolving comb in intermediate points between the end supporting members by an arrangement which reliably provides an efficient anchorage to resist the active forces, as well as a wide supporting surface to secure a correct mechanical operation.

In solving this problem by the present invention, it has been found that the space occupied by the thickness of the disks of the comb is very small as compared with the gap between consecutive disks and, moreover, that the outline of the bottom surface of the inter-disk gap is circular in outline and has a small diameter. The result is that the exploitation of these areas for supporting the shaft affords a number of advantages, such as an adequate contact area, a shape which is particularly favorable to be used for this task, a small diameter which permits that a fair positioning of the resting points and the directions of the reactive forces may be obtained, and a reduced surface speed of the contact surfaces.

The supporting members include a certain number of rollers, or pads, or combination roller and pads in the form of blades which, by penetrating the interdisk gap, contact the gap bottom in order to support the shaft. The piece which is in direct contact with the supporting members is a spreading ring for the comb disks, and the materials forming the pieces in mutual contact are appropriately selected. The number of such supporting members, and their arrangement, as well, are a function of the requirements of the machine.

Exemplary embodiments of this invention are shown in a diagrammatical way in the accompanying drawings to be described in more detail hereinafter.

Figure 1:
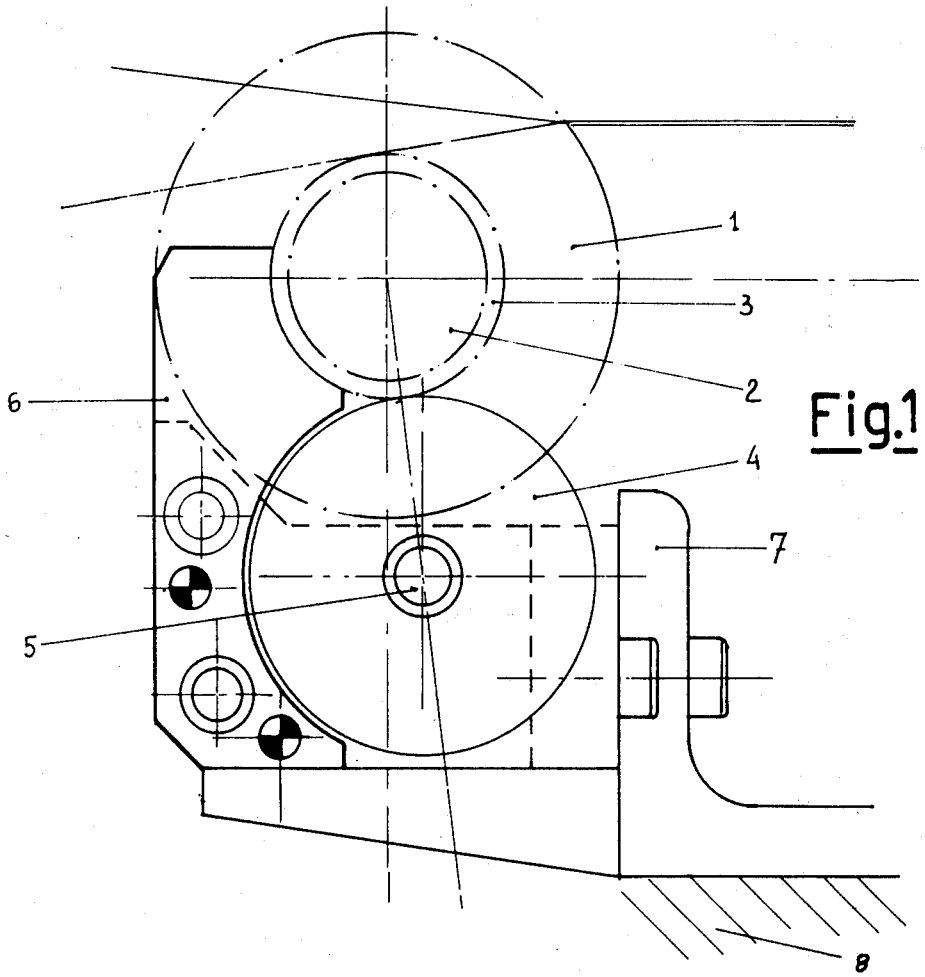
FIG. 1 is a side elevational view of a combination supporting members which includes rollers and pads.
Figure 2:
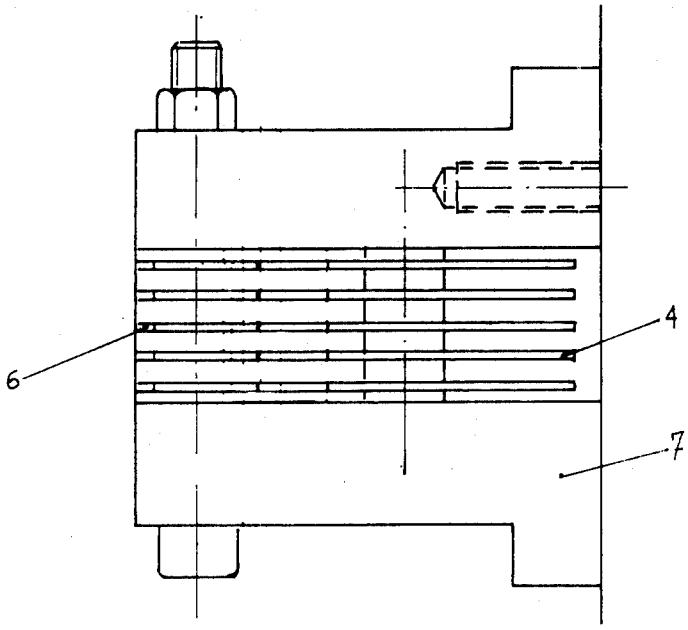
FIG. 2 is a plan view of the device shown in FIG. 1.

The beating-up disks of the revolving comb 1 are ganged on the shaft 2 and properly spread apart by rings 3. The baseplate 7 of the supporting member is affixed to the machine frame 8 and carries, for idle movement, a shaft 5 which is rotated with a set of disks 4, these latter contacting the spreader 3, and a set of pads 6, also contacting the spreader 3.

The disk 1, the shaft 2 and the spreader 3 make up an entity and rotate together and drag into rotation by friction the shaft 5 and the disks 4 on which the predominant fraction of the gravity pull forces is discharged. The disks 4 are allowed to carry out small displacements in the axial direction in order to become aligned with the pads 6.

Figure 3:
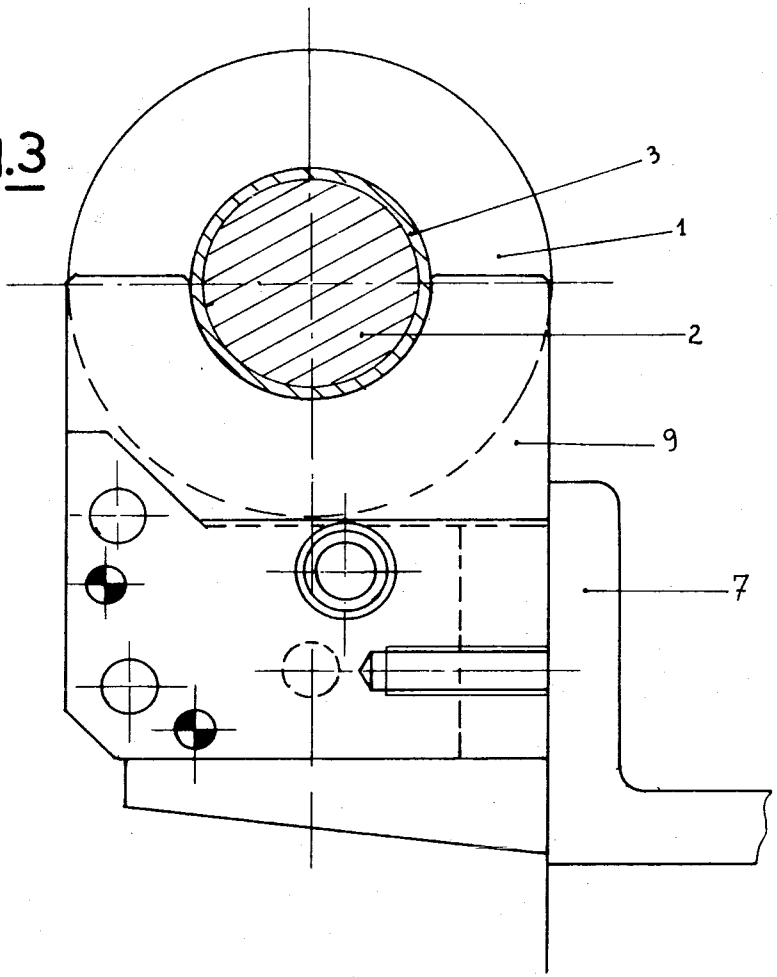
FIG. 3 is a side elevational view of a supporting member which includes pads only.

In FIG. 3, the supporting member is active upon the spreader 3 by means of the pad 9 which is about 180 degrees of the circumference.

Figure 4:
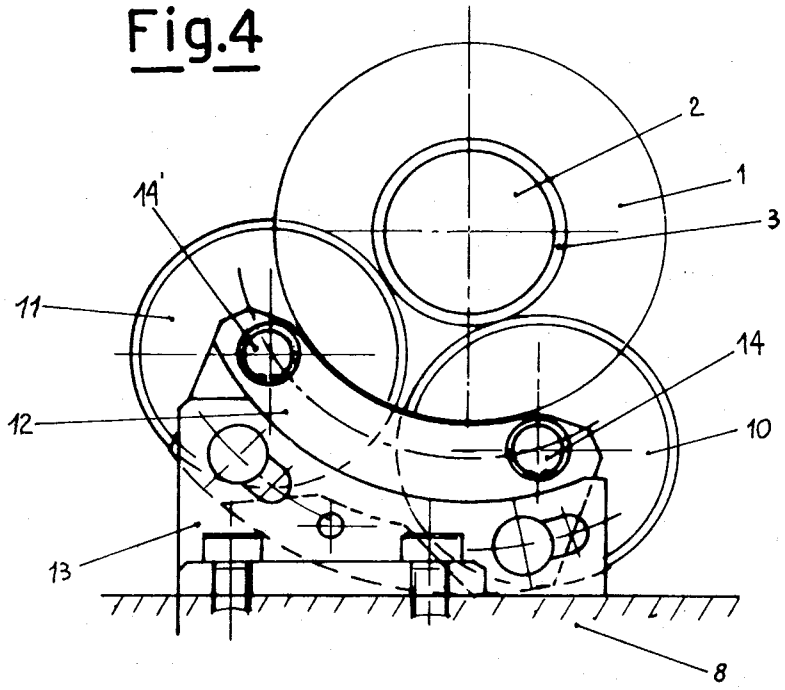
FIG. 4 is a side elevational view of a supporting member which includes rocking rollers.

In FIG. 4, two rollers 10 are shown, which are active upon the spreader 3: these rollers are placed on shafts 14 and 14', as mounted on a small frame 12, the latter being allowed to be rotated on the baseplate 13 relative to the axis of the revolving comb in order to provide a fair contact of both the roller sets on the spreader 3.

What I claim is:

1. A device for supporting, at intermediate points, a revolving comb of a multished loom having weft-thread grasping and beating-up disks mounted in a ganged helical array on a shaft with spreaders therebetween, comprising: a base plate affixed to the frame of the loom, and a set of members on said base plate having a blade-like shape adapted to be inserted between the grasping and beating-up disks of the revolving comb until said members contact and act upon the spreaders confined between said disks, and wherein said members are mounted on said base plate so as to be spread relative to one another and to allow relative movement therebetween for undergoing small displacements in order to become spontaneously arranged in the desired position in contact with said spreaders, and said spreaders having cylindrical surfaces upon which said members act and having a small size as compared to the size of the grasping and beating-up disks, to thereby provide for efficient positioning of said members for counteracting the thrust originated by the weft-thread shot.

2. The device set forth in claim 1 wherein said members on said base plate are disks.

3. The device set forth in claim 1 wherein said members on said base plate are pads.

4. The device set forth in claim 1 wherein said members on said base plate are pads and disks which both contact said spreaders between the grasping and beating-up disks.

5. The device set forth in claim 1, comprising: a small frame rotatably mounted on said base plate, and wherein said members include rollers rotatably mounted on shafts which, in turn, are rotatably mounted on said small frame.

* * * * *

UNITED STATES PATENT AND TRADEMARK OFFICE

CERTIFICATE OF CORRECTION

PATENT NO. : 4,068,685
DATED : January 17, 1978
INVENTOR(S) : Nicola Santucci, et al It is certified that error appears in the above-identified patent and that said Letters Patent are hereby corrected as shown below:

First page, Correct line "[73]" to read

-- [73] Assignees: Nuovo Pignone S.p.A. and ZNIKHBI: Tsentralny Nauchne-issledevatelsky institut khlopehatobumezhnoi promyshlennesti--.

Column 1, line 29, After "random" insert a comma --,--.

line 62, After "comb" insert a period --.-- and Correct "which" to read --With--.

Signed and Sealed this

*Twentieth* Day of *June 1978*

[SEAL]

*Attest:*

RUTH C. MASON
*Attesting Officer*

DONALD W. BANNER
*Commissioner of Patents and Trademarks*